US006830001B1

(12) United States Patent
Heran et al.

(10) Patent No.: US 6,830,001 B1
(45) Date of Patent: Dec. 14, 2004

(54) PYROLYSIS FURNACE HAVING IMPROVED HEATING EFFICIENCY

(75) Inventors: Rogert F. Heran, Westlake, OH (US); Robert A. Koptis, Brook Park, OH (US)

(73) Assignee: Armature Coil Equipment, Inc., Cleveland, OH (US)

( * ) Notice: Subject to any disclaimer, the term of this patent is extended or adjusted under 35 U.S.C. 154(b) by 1 day.

(21) Appl. No.: 10/368,047

(22) Filed: Feb. 14, 2003

(51) Int. Cl.[7] ..... F23B 5/027; F23B 7/00
(52) U.S. Cl. ..... 110/236; 110/341
(58) Field of Search ..... 110/236, 322, 110/326, 341; 431/8

(56) References Cited

U.S. PATENT DOCUMENTS 2,638,889 A * 5/1953 Dow ..... 126/91 A
2,752,897 A * 7/1956 Mekler ..... 122/262
3,807,321 A * 4/1974 Stockman ..... 110/236
4,270,898 A * 6/1981 Kelly ..... 432/19
4,557,203 A * 12/1985 Mainord ..... 110/344
4,970,969 A * 11/1990 Koptis et al. ..... 110/190
5,189,963 A * 3/1993 Mann ..... 110/190
5,826,520 A * 10/1998 Mainord ..... 110/342

* cited by examiner

*Primary Examiner*—Kenneth Rinehart
(74) *Attorney, Agent, or Firm*—John F. McDevitt

(57) ABSTRACT

A batch type pyrolysis furnace is described for the removal of organic contaminants from various metal parts with superior heating efficiency. The described pyrolysis furnace employs a modified gas burner construction providing combined radiant and convection heating to carry out the pyrolysis cycle in shorter heat-up and cool-down time periods accompanied by fuel savings. A novel furnace apparatus and method for its operation to achieve these benefits is disclosed.

16 Claims, 1 Drawing Sheet

PYROLYSIS FURNACE HAVING IMPROVED HEATING EFFICIENCY

BACKGROUND OF THE INVENTION

This invention relates generally to the manner of operation of a pyrolysis type furnace for removal of various organic contaminants from metal parts and more particularly to a novel manner for said furnace operation which provides superior heating efficiency.

In our earlier issued U.S. Pat. No. 4,970,969 there is described a novel batch type pyrolysis furnace for volatilizing and burning organic material from a metal part to which said organic material is bonded. This furnace apparatus employs a main combustion chamber operating at negative chamber pressure which is heated with an adjustable heating rate burner to directly heat air ducted into said main combustion chamber by convection heat transfer. A supplemental combustion chamber in open communication with said main combustion chamber and vented to the atmosphere contains an auxiliary burner to complete combustion of the volatilized organic contaminants being transported from the main combustion chamber. A single temperature sensing means is disposed within said main combustion chamber together with water spray means responsive to said temperature sensing means for operative cooperation with said adjustable heating rate burner to regulate operating temperatures within said main combustion chamber in accordance with a preselected heating schedule. Control of the furnace operation includes programmable temperature control means to maintain continuous operation of said adjustable heating rate burner with (i) a normal full supply of fuel necessary to maintain full combustion in the presence of excess oxygen during a major portion of the pyrolysis cycle, said excess oxygen being relative to the amount required to burn the fuel in said burner, and (ii) a diminished supply of fuel sufficient to maintain fuel-starved combustion during the final portion of the pyrolysis cycle, also in the presence of excess oxygen. The entire contents of my earlier issued patent are hereby specifically incorporated into the present application since the present invention provides a superior manner of operating this same type pyrolysis furnace.

Said prior art method of heating air solely by convection in this type furnace is subject to serious drawbacks including a relatively low rate of heat transfer as well as an inherent requirement for air movement. These heating characteristics result in longer startup and cool down periods for the pyrolysis cycle. Understandably, such extended furnace operation to complete the pyrolysis cycle further increases both fuel and still other operating costs. Heating solely with convection heating means can also increase furnace equipment costs by utilization of recirculating fans to improve air movement during the pyrolysis cycle. Having the present pyrolysis cycle being carried out entirely with convection heating results in still further drawbacks attributable to uneven heating taking place in the main combustion chamber. The contaminated metal parts in the main combustion chamber are heated non-uniformly resulting in damaged products while uneven heating also produces cold spots in the furnace enclosure with stratification of warm air at roof level further wasting fuel efficiency.

It is an important object of the present invention, therefore, to provide a more effective means to remove organic contaminants from metal parts in a pyrolysis furnace.

It is another important object of the present invention to provide novel heating means in a pyrolysis furnace exhibiting superior heating efficiency.

Still another important object of the present is to provide novel heating means in a batch type pyrolysis furnace for energy savings and shorter time cycles.

Still another important object of the present invention is to provide a novel method for heating in a pyrolysis furnace.

These and still further objects of the present invention will become more apparent upon considering the following more detailed description of the present invention.

SUMMARY OF THE INVENTION

It has been discovered, surprisingly, that removal of organic contaminants from metal parts in a pyrolysis furnace can be carried out more effectively with combined radiant and convection heating in a particular manner during the pyrolysis cycle. More particularly, the processing procedure of the present invention employs a pyrolysis furnace having a main combustion chamber employing an adjustable heating rate burner adapted to supply both convection and radiant heating energy to directly heat air ducted into said main combustion chamber for passage of the volatilized organic contaminants into a supplemental combustion chamber in open communication with said main combustion chamber and vented to the atmosphere which further contains an auxiliary burner. In said operating procedure, the main combustion chamber is operated with a single temperature sensing means in combination with control means including programmable temperature control means to maintain continuous operation of said adjustable heating rate burner with (i) a normal fuel supply necessary to maintain full combustion of said organic contaminants in the presence of excess oxygen during a major portion of the pyrolysis cycle, said excess oxygen being relative to the amount required to burn the fuel in said burner, and (ii) a diminished supply of fuel sufficient to maintain fuel-starved combustion during the final portion of the pyrolysis cycle, also in the presence of excess oxygen, while further activating a water spray within said main combustion chamber responsive to said temperature sensing means for operative cooperation with said adjustable heating rate burner to regulate operating temperature within said combustion chamber in accordance with a preselected heating schedule, and employing said auxiliary burner to complete the combustion of the volatilized organic contaminants being transported from the main combustion chamber within said supplemental combustion chamber. A suitable adjustable heating rate burner enabling the desired purpose can simply feature a radiant tube extension protruding from the front end of said burner which further includes multiple openings along the tube length. Said modified burner assembly can be easily positioned beneath the cart member containing the contaminated metal parts being processed within the main combustion chamber. Employing such heating means enables the modified gas burner to fire directly into the length of the radiant tube extension for its rapid heating as the radiant energy source while simultaneously supplying convection heating with flames emerging evenly out the tube openings. The illustrated burner construction has been found to enable a 50% improvement for the present operating procedure in rapid heat-up and cool-down during shortened cycle times accompanied by a 20% fuel savings.

DETAILED DESCRIPTION OF THE PREFERRED EMBODIMENTS

Figure 1:
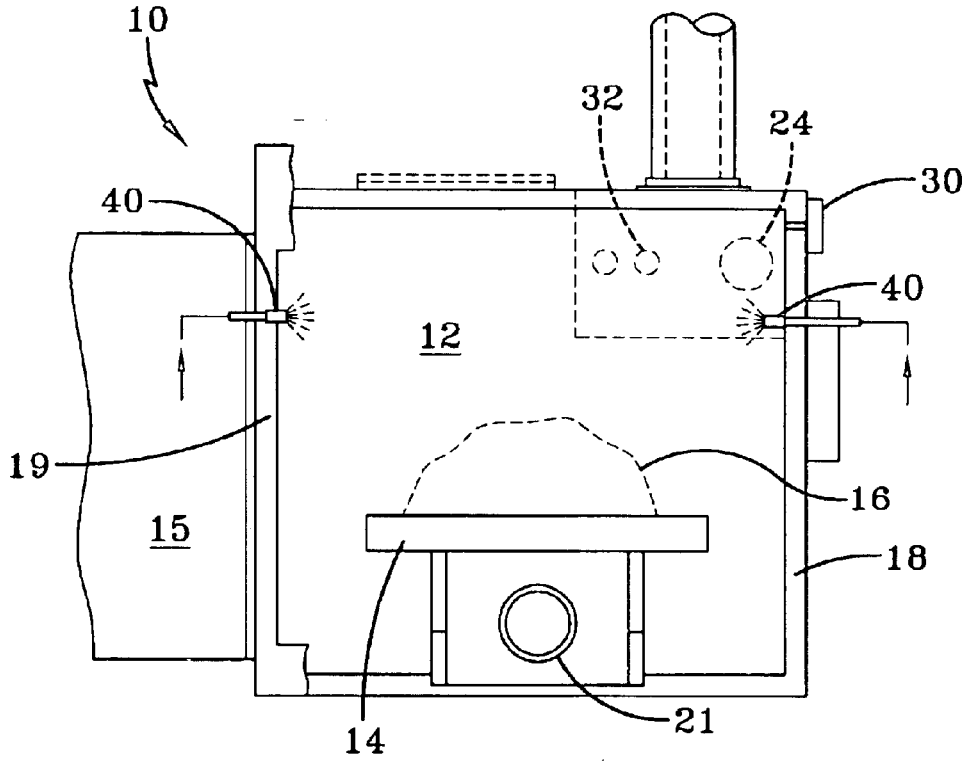
FIG. 1 is a front elevational view of a representative pyrolysis furnace according to the present invention which is controlled by a single temperature sensing means in accordance with a preselected heating schedule.
Figure 2:
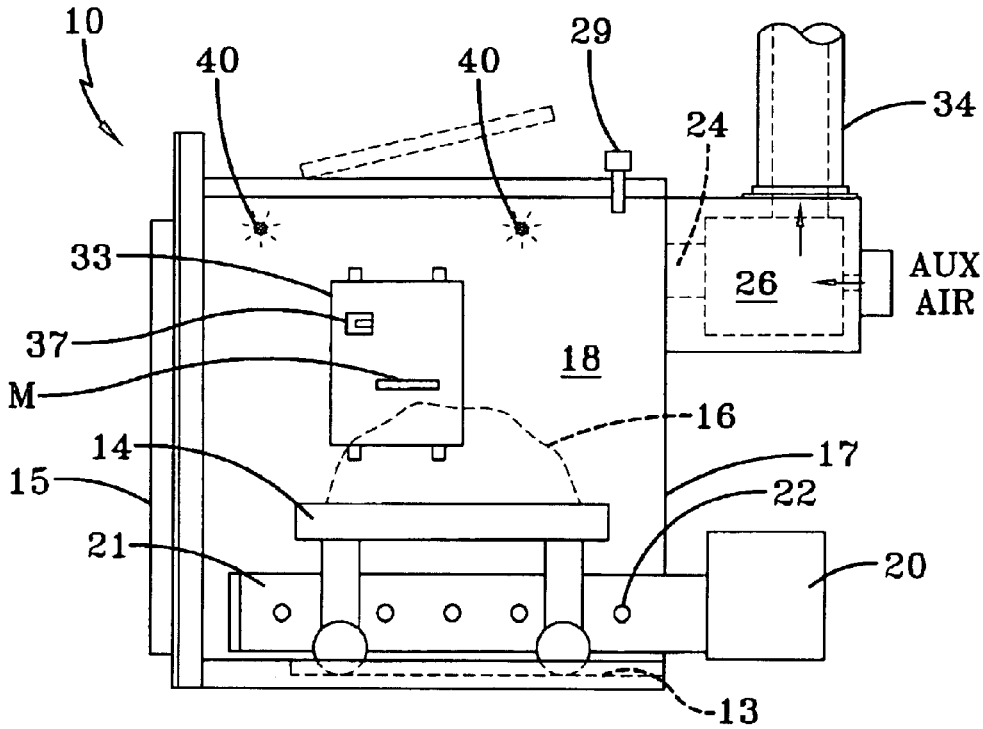
FIG. 2 is a side elevational view depicting the FIG. 1 furnace construction together with the control means being employed to regulate operating temperatures during the pyrolysis process.

Referring to the drawings, FIGS. 1–2 depicts schematically a representative pyrolysis furnace construction which can be employed to completely remove organic contaminants from various metal parts in a far more effective manner. More particularly, novel radiant heating means are now combined with convection heating means in the illustrated furnace embodiment to enable a more rapid pyrolysis of the organic contaminants with lesser fuel expenditure. Said furnace 10 is typically a large enclosed physical structure which can be shaped as a rectangular parallelepiped having a main combustion chamber 12. The floor 13 of said main combustion chambers holds a cart member 14 which can be admitted thru furnace door 15. Said cart member contain a batch 16 of the contaminated metal parts being pyrolized while the depicted furnace enclosure includes a rear wall 17, a right side wall 18 and a left side wall 19. Said main combustion chamber 12 is also suitably insulated with ceramic fiber. An adjustable heating rate gas burner 20 having a closed end radiant tube extension 21 is provided in said main combustion chamber to volatilize the organic contaminants in accordance with the presently improved procedure. The gas burner being employed operates either with a normal or "full burner" fuel supply or with a diminished or "fuel-starved" fuel supply during the pyrolysis cycle in a controlled manner to be more fully explained hereinafter. The type of adjustable heating rate burner being selected generally depends upon the batch size and composition of the organic contaminants as well as physical size of the main combustion chamber. For example, in a representative size chamber having a width of 4 feet, a length of 4 feet and a height of 4 feet within which a batch charge of about 500 lbs of motor mounts contaminated with 25% rubber insulation is to be processed, a Midco Incinomite burner having a rated output of 100,000 BTu/hr can be used. The selected burner is desirably adjusted to operate with an excess of oxygen wile further providing flame to the far end of the radiant tube extension 21 including emergence from openings 22 in the tube walls. Such mode of operation for directly heating air ducted into said main combustion chamber 12 results in a negative chamber pressure which is maintained throughout the pyrolysis cycle. A suitable radiant tube extension 21 can be fabricated with various heat resistant materials, such as stainless steel, to desirably project the entire length of said main combustion chamber and be physically placed beneath the cart member 14 containing the contaminated metal parts. In said manner, the heated tube directs the radiant energy upward in a relatively uniform pattern over an extended area. An 8 inch diameter stainless steel tube was selected for the radiant tube extension member being depicted having 2 inch diameter holes provided on each side of the tube walls.

There is also provided in the present furnace embodiment a supplemental combustion chamber 26 in open communication with said main combustion chamber via throat 24 and which includes an auxiliary burner 30 to complete the combustion of the volatilized organic contaminants being transported from said main combustion chamber. Said auxiliary combustion chamber includes openings 32 vented to the atmosphere for air introduction to supply oxygen for complete combustion of the volatilized organic contaminants as well as an exhaust stack 34.

Control means for operation of said presently illustrated furnace embodiment includes programmable temperature control means to maintain continuous operation of said adjustable heating rate burner throughout the entire pyrolysis cycle with (i) a normal full supply of fuel necessary to maintain full combustion in the presence of excess oxygen during a major portion of the pyrolysis cycle, said excess of oxygen being relative to the amount required to burn the fuel in said burner, and (ii) a diminished supply of fuel sufficient to maintain fuel-starved combustion during the final portion of the pyrolysis cycle, also in the presence of excess oxygen. Said present control procedure employs a single thermocouple 29 disposed in the main combustion chamber for transmission of the control signals to said temperature control means 37 mounted on electrical panel 33 in the furnace apparatus. A manometer M (shown in FIG. 2) is also mounted on said control panel to insure negative pressure conditions being maintained in said main combustion chamber. Operation of said programmable temperature control means proceeds in the same general manner more fully explained in our aforementioned previously issued United States Patent. Operating temperatures in the main combustion chamber are thereby raised in preestablished incremental stages. In further accordance therewith, water spray means 40 disposed in the main combustion chamber responds to the temperature sensing means for operative cooperation with said adjustable heating rate burner to regulate operating temperatures within said main combustion chamber pursuant to said preselected heating schedule. Combustion efficiency reaches approximately 90% for the herein illustrated embodiment when carried out in the above described manner.

It will be apparent from the foregoing description that a broadly useful and novel means to remove organic contaminants from various metal parts has been provided. It is also contemplated that already known modifications can be made in the disclosed furnace apparatus and method for its operation than herein specifically recited without departing from the present invention. For example, the employment of additional burners in the main or supplemental combustion chambers can be permitted although complicating the control procedure associated with multiple heat sources. Likewise, multiple temperature sensing means in the disclosed apparatus to further monitor the pyrolysis cycle in certain other respects can also complicate the present control procedure. Consequently, it is intended to cover all variations of the present improvements which may be devised by persons skilled in the art as falling within the true spirit and scope of the herein claimed invention.

What we claim as new and desire to secure by Letters Patent of the United States is:

1. A pyrolysis furnace having:

(a) a physical enclosure operating at negative chamber pressure to reclaim metal parts contaminated with combustible organic materials, (b) pressure sensing means disposed within said enclosure to monitor said negative chamber pressure operating conditions, (c) a first adjustable heating rate gas burner to directly heat air ducted into said enclosure, said first gas burner having a tubular extension physically connected to its flame end to combine radiant heating with convection heating within said enclosure during contaminant combustion, (d) a supplemental combustion chamber in open communication with said enclosure and vented to the atmosphere containing a second auxiliary gas burner, (e) single temperature sensing means disposed within said enclosure, (f) water spray means responsive to said temperature sensing means for operative cooperation with said first adjustable heating rate gas burner to regulate operating temperatures within said enclosure in accordance with a preselected heating schedule, and (g) control means including programmable temperature control means to maintain continuous operation of said first adjustable heating rate gas burner with (i) a normal full supply of fuel necessary to maintain full contaminant combustion during a major portion of the pyrolysis cycle, and (ii) a diminished supply of fuel sufficient to maintain fuel-starved combustion during the final portion of the pyrolysis cycle in the presence of excess oxygen.

2. The pyrolysis furnace of claim 1 wherein multiple water spray means cooperate to regulate operating temperatures within said enclosure.

3. The pyrolysis furnace of claim 2 wherein said multiple water spray means cooperate when operating temperatures within said enclosure exceed a preselected value.

4. The pyrolysis furnace of claim 1 wherein the single temperature sensing means is physically located within said enclosure to measure the temperature of the volatilized contaminants being produced therein.

5. The pyrolysis furnace of claim 1 wherein the tubular extension projecting from the first adjustable heating rate gas burner has a hollow cylindrical shape.

6. The pyrolysis furnace of claim 1 wherein the tubular extension projecting from the first adjustable heating rate gas burner has a closed terminal end.

7. The pyrolysis furnace of claim 6 wherein the tubular extension projecting from the first adjustable heating rate gas burner includes multiple openings along its length.

8. The pyrolysis furnace of claim 1 wherein said first adjustable heating rate gas burner comprises a gas burner with its flame end physically connected to a hollow closed end cylindrical tube extension fabricated with a heat resistant material, said tube extension having multiple openings along its length.

9. A method to remove organic contaminants from metal parts in a pyrolysis furnace having a physical enclosure employing a first adjustable heating rate gas burner having a tubular extension physically joined to its flame end and adapted to supply both convection and radiant heating energy to directly heat air ducted into said enclosure for passage of the volatilized organic contaminants into a supplemental combustion chamber in open communication with said enclosure and vented to the atmosphere containing an a second auxiliary gas burner, said method comprising:

(a) operating said enclosure at negative chamber pressure with a single temperature sensing means in combination with control means including programmable temperature control means to maintain continuous operation of said first adjustable heating rate gas burner with (i) a normal fuel supply necessary to maintain full combustion of said organic contaminants during a major portion of the pyrolysis cycle, and (ii) a diminished supply of fuel sufficient to maintain first-starved combustion during the final portion of the pyrolysis cycle in the presence of excess oxygen, (b) activating water spray means within said enclosure responsive to said temperature sensing means for operative cooperation with said first adjustable heating rate gas burner to regulate operating temperatures within said enclosure in accordance with a preselected heating schedule, and (c) employing said second auxiliary gas burner to complete combustion of the volatilized organic contaminants being transported from the enclosure within said supplemental combustion chamber.

10. The method to claim 9 wherein the preselected heating schedule being controlled by said programmable temperature control means raises the operating temperatures in said enclosure in incremental steps.

11. The method of claim 10 wherein said programmable temperature control means comprises a programmable controller.

12. The method of claim 9 wherein operation of the first adjustable heating rate gas burner is terminated only upon completion of the pyrolysis cycle.

13. The method of claim 9 wherein no visible smoke emerges from the supplemental combustion chamber.

14. The method of claim 9 wherein said water spray means is actuated upon exceeding a preestablished operating temperature in said enclosure.

15. The method of claim 14 wherein multiple water sprays are employed.

16. The method of claim 14 wherein chamber pressure in said enclosure is monitored with nanometer means.

* * * * *